United States Patent [19]

Byer

[11] 4,445,645

[45] May 1, 1984

[54] ROLL RETAINING MEANS FOR A DISPENSING BOX

[76] Inventor: Joseph I. Byer, 2896 Radisson Ave., Windsor, Canada

[21] Appl. No.: 223,681

[22] Filed: Jan. 9, 1981

[51] Int. Cl.[3] ..... B65H 19/00

[52] U.S. Cl. ..... 242/55.53; 206/389; 225/47

[58] Field of Search ..... 242/55.2, 55.53, 55.55, 242/137–138; 225/46, 47, 65, 66, 77; 206/389, 397

[56] References Cited

U.S. PATENT DOCUMENTS

| | | | |
|---|---|---|---|
| 391,379 | 10/1888 | Mitchamore . | |
| 1,122,674 | 12/1914 | Winter et al. . | |
| 2,381,229 | 8/1945 | Shalhoub | 242/55.5 |
| 2,579,149 | 12/1951 | Krueger et al. | 242/55.5 |
| 2,743,009 | 4/1956 | Williamson et al. | 206/58 |
| 2,836,292 | 5/1958 | Klein et al. | 225/47 |
| 2,861,753 | 11/1958 | Sipior | 242/55.53 |
| 3,228,579 | 1/1966 | Dong et al. | 225/23 |

FOREIGN PATENT DOCUMENTS

| | | | |
|---|---|---|---|
| 2400178 | 7/1975 | Fed. Rep. of Germany | 225/65 |

*Primary Examiner*—Leonard D. Christian
*Attorney, Agent, or Firm*—Jerry G. Beck

[57] ABSTRACT

A roll retaining means for retaining a roll of sheeting material in a dispensing box comprising a rod having two end segments with one of the segments being provided with a piercing means and a sleeve mounted thereon adjacent to the piercing means, the sleeve, upon being inserted through an end wall of the dispensing box, retains the roll in position when the other of the end segments is secured to the box.

12 Claims, 7 Drawing Figures

ROLL RETAINING MEANS FOR A DISPENSING BOX

A roll retaining means of this invention is adopted for retaining a roll of sheeting material such as foil or paper in a dispensing box. The box is conventional and is provided with standard end walls and side walls. The roll retaining means comprises a rod having at least two segments with a sleeve rotatable supported on one segment. The other segment has an attachment means for securing the roll retaining means to one of the walls of the box while the sleeve on the other segment is positioned so as to be in a tangential relationship with the inner periphery of the roll on which the sheeting material is wound.

BACKGROUND OF THE INVENTION

The roll retaining means of this invention relates to a sleeve that is manually insertable into a cardboard box or carton through its end wall.

I have found that when a sheeting material such as paper or thin plastic wound on a core or roll to be dispensed through an opening in a box or carton, uneven pulling on the end of the sheeting material will cause the core on which the sheeting material is wound to tilt within the box and prevent further dispensing of the sheeting material or cause the entire roll to pop out of the box to the annoyance of the user. If thin plastic sheeting is involved, even greater difficulty is frequently encountered to remount the core within the box and to commence dispensing the thin plastic sheeting again from the box.

The tilting action or the popping out of the roll of sheeting material occurs as a result of uneven pulling on the sheeting material exposed on the outside of the box which causes the ends of the roll to be dislocated from their aligned position with the inside end walls of the box unless extensive mounting and retaining means have been provided to keep the ends of the roll from moving out of position. This is usually not the case with disposable boxes or cartons from which paper or thin plastic sheeting is dispensed for household use.

PRIOR ART STATEMENT

A prior art search was conducted on the roll retaining means for a disposable dispenser such as a box or cartons. U.S. Pat. No. 2,381,229 depicts a paper roll dispenser provided with a rectangular boss urged by spring action into an rectangular opening in a hub which is adopted to have the ends or a cylinder of a roll of paper rotatably mounted thereon.

U.S. Pat. No. 3,228,579 discloses a rotatable cap which engages the interior of a core upon which a sheeting material is wound. The rotatable cap is also formed as a cone engaging the entire inner periphery of the end portion of the core.

In the tape dispensing machine described in U.S. Pat. No. 2,579,149, the tape is wound on a hollow spool which is supported through its entire length of the spool by a pin secured at one end to the side plate of the dispensing maching. The other end of the pin is provided with a head to retain the spool on the pin.

Other paper dispensing devices which include means for holding spools or rolls of paper in a box or carton are shown in U.S. Pat. Nos. 391,379; 1,122,674; and 2,743,009; but all these retaining devices are permanently incorporating into the end portions of the dispensing device, thereby substantially increasing the cost of disposable boxes sold to consumers.

SUMMARY OF THE INVENTION

The invention relates to a roll retaining means, which, upon insertion through the end walls of a box containing a roll of sheeting material to be dispensed from the box, assures that the roll is retained about its longitudinal axis in the box by keeping the roll from tilting in or popping out of the box.

Very frequently, especially with thin plastic sheeting, the plastic wound on a roll will tear while being dispensed through an opening in the box because the roll binds or hangs up causing frustation to the dispenser. To correct this situation, the box has to be opened, the roll removed to unravel the plastic sheeting and then the roll is placed back in the box. This is very difficult at times, especially with thin plastic sheeting or foil and may result in a substantial waste of sheeting material before the situation is corrected.

In accordance with the teachings of this invention, a simple roll retaining means is provided which comprises a sleeve supported on one end segment of a rod which is easily insertable through the end wall of a box or carton so as to position the outside diameter of the sleeve in an abutting relationship in a tangential position with the inner peripheral surface of one end portion of the roll on which the sheeting material is wound and which is contained within the box. The other end segment of the rod is provided with an attachment means to permit the roll retaining means to be secured to the box so as to maintain the sleeve in position after it has been inserted into the box. The attachment means can comprise a disc which can be manually secured to the walls of the box by a staple, spike or tape.

In accordance with other embodiments of this invention, the roll retaining means can comprise an U-shaped rod or wire with a pivotable mounted sleeve on one end segment thereof which is insertable through the end wall of a box so that it can be positioned into tangential contact with the inner peripheral surface of the roll in the box. The other end segment of the rod serves as an attachment means to one of the walls of the box. This can be accomplished by various securing means, either by the spring action of the U-shaped rod which forces the attachment means into a tight and secure relationship with the side wall of the box or by such means as a spike that bites into the cardboard side wall of the box or by the use of staples.

A L-shaped rod can also be utilized on which a pivotable sleeve is mounted on the long leg segment thereof which then is inserted into the box. The shorter leg segment of the L-shaped rod remains outside the box and is provided with an attachment means to secure the roll retaining means to the end wall of the box. The attachment means can be similar to the ones described in the previous embodiments.

In a further embodiment of this invention, the roll retaining means comprises a rod which has end segments that can be inserted through opposite end walls of a box. A sleeve is pivotable mounted on each end segment, and upon the insertion of the sleeves through the end walls of the box, the sleeves will engage the inner peripheral surface of the respective end portions of the roll on which the sheeting is wound and which is contained in the box. The end segments of the rod are interconnected by a longitudinally extending central segment that extends the entire longitudinal length of the box and is provided with sufficient spring action to allow the insertion of the sleeves through opposite end walls by bending the end segments of the rod upward and then releasing them.

All embodiments of this invention provide a simple, cheap roll retaining means that is readily insertable manually into a box or carton in which a roll of sheeting material is contained so as to allow the sheeting material to be readily dispensed for its entire length without encountering any difficulties.

DESCRIPTION OF THE PREFERRED EMBODIMENT

Figure 1:
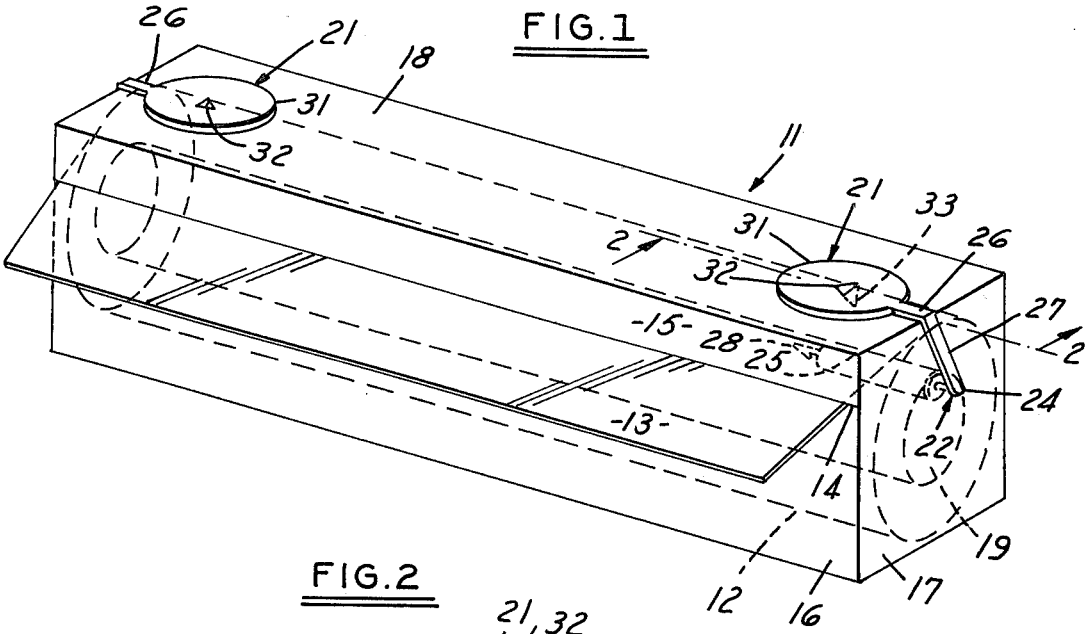
FIG. 1 is a perspective view of a box used for dispensing sheeting material from a roll with the roll retaining means of the first embodiment in place.

In FIG. 1 is seen a box 11 or carton usually fabricated from cardboard which contains a roll 12 or core of paper or plastic sheeting 13 wound thereon. The sheeting 13 extends through a longitudinal opening 14 either cut into the box 11 or formed by the cover 15 of the box 11 extending over the front wall 16 thereof to allow dispensing of the sheeting 13 from the box 11. The box 11, besides the front wall 16, is defined by two end walls 17 and three other longitudinally extending side walls 18. The box 11 serves as an enclosure for the sheeting 13 wound on the roll 12. The roll 12 which is, in this case, a hollow cylinder fabricated from cardboard provided with an inner peripheral surface 19. The sheeting 13 is wound upon the outer peripheral surface of the roll 12.

Figure 2:
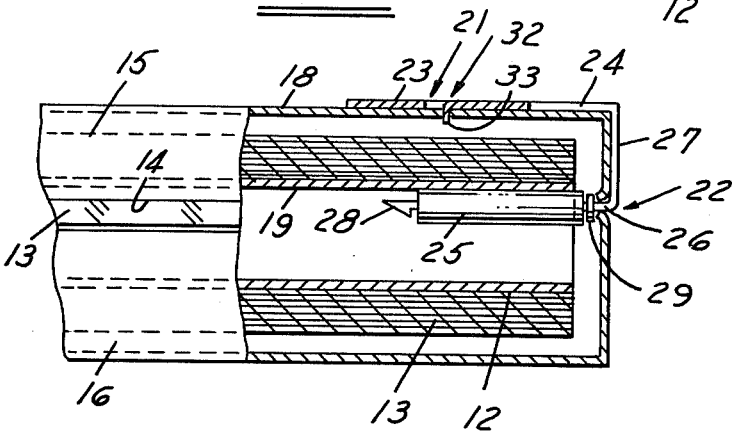
FIG. 2 is a fragmentary vertical section taken longitudinally of the box along line 2—2 of FIG. 1.

A roll retaining means 21 of the first embodiment of this invention is shown in FIGS. 1 and 2. The roll retaining means 21 comprises a rod 22 which, in the first embodiment, is U-shaped with an attachment means 23 on one end segment 24 of the U-shaped rod 22 and a sleeve 25 which either can be a pivotable cylinder mounted on the other end segment 26 of the rod 22 or it could be integrally formed with the other end segment 26 of the rod 22 so as to provide a contact surface with the inner peripheral surface of the roll 12. As best seen in FIG. 2, the end segments 24 and 26 are integrally formed with a center segment 27 to define the U-shaped rod 22. The other end segment 26 is provided with a piercing means 28 at its tip. The piercing means 28 can be formed by an angular bend of the tip portion of the segment 26 or by welding an arrow head to the end thereof. The piercing means 28 also serves as a retainer for one end of the sleeve 25 if a cylinder is utilized. A retainer ring 29 can be mounted or integrally formed with the segment 26 at the opposite side of the sleeve 25 if a cylindrical sleeve is used to assist in retaining such a sleeve on the rod 22. The attachment means 23 in this embodiment comprises a flat disc brazed or welded to the end segment 24 of the rod 23. The flat disc 31 is provided with a securing means 32 to attach the flat disc 31 to the side wall 18 of the box 11. In this instance, an inward facing spike 33 stamped from the surface of the disc 31 is shown penetrating the side wall 18 to secure the roll retaining means 21 to the box 11. Other securing means 32 such as staples or tape, can be utilized in lieu of the spike 33.

In the teachings of this invention, the other end segment 26 of the rod 22 is pushed through the end wall 18 of the box 11 with the piercing means 28 provided to facilitate the piercing of the end wall 18 and the insertion of the sleeve 25 through the pierced hole. The piercing of the end wall 18 is performed at a point where, upon insertion of the sleeve 25 into the box 11, the sleeve 25 will be contacting tangentially the inner peripheral surface 19 of the roll 12 as best seen in FIG. 2. The sleeve 25 can be inserted so that it is in tangential contact with the inner peripheral surface 19 of the roll 12 radially displaced from a vertical line passing through the center of the roll 12 when viewed towards the end wall 17 of the box 11. The one end segment 24 with the attachment means 23 and the center segment 27 of the rod 22 remain on the exterior of the box 11 with the disc 31 in juxtaposition with the side wall 18. The spike 33 is pushed into the side wall 18 to secure the roll retaining means 21 firmly to the box 11. It is to be understood that the attachment means 23 can be in juxtaposition with any of the side walls 18 of the box 11.

Figure 3:
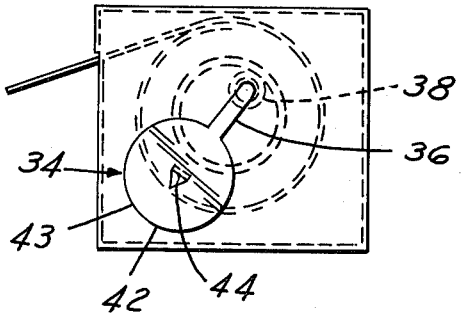
FIG. 3 is an end view of a box in which a second embodiment of the roll retaining means of this invention is incorporated therein.
Figure 4:
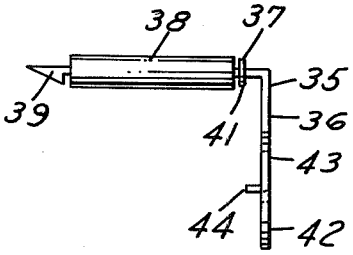
FIG. 4 is a side view of the roll retaining means of the second embodiment of this invention shown in FIG. 3.

In FIGS. 3 and 4, a second embodiment of the roll retaining means 34 is shown. The roll retaining means 34 comprises a L-shaped rod 35 with a short leg segment 36 and a long leg segment 37 which is provided with a sleeve 38 pivotable mounted thereon. A piercing means 39 is formed at the tip of the long leg segment 37. A retainer ring 41 keeps the sleeve 38 from sliding outwardly on the long leg segment 37. The short leg segment 36 of the rod 35 is provided with an attachment means 42 to facilitate attaching the roll retaining means 34 to the end wall 17 of the box 11.

The attachment means 42 illustrated in FIGS. 3 and 4 comprises a disc 43 which has an inward facing spike 44 that pierces the end wall as seen best in FIG. 3. In the alternative the attachment means 42 could be molded in the end wall 17 by the box manufacturer so that the long leg segment 37 of the rod 11 with the sleeve 38 mounted thereon is already in abutment with the inner peripheral surface 19 of the roll 12 inside the box 11 and does not have to be inserted through the end wall 17 by the consumer.

Figure 5:
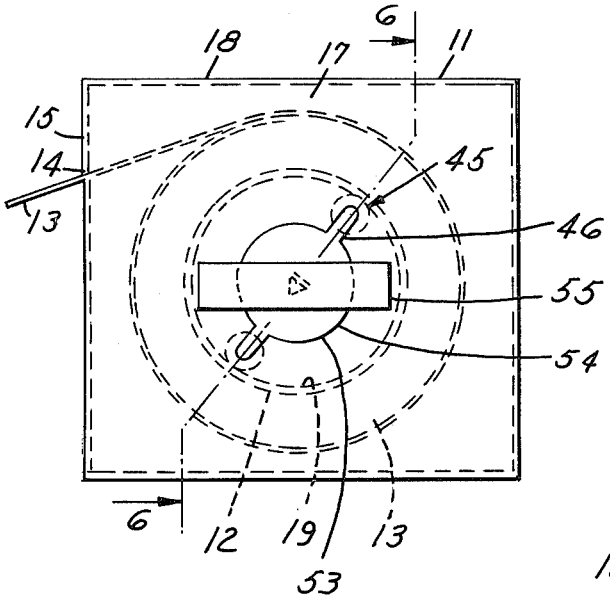
FIG. 5 is an end view of a box in which a third embodiment of the roll retaining means of this invention is incorporated therein.
Figure 6:
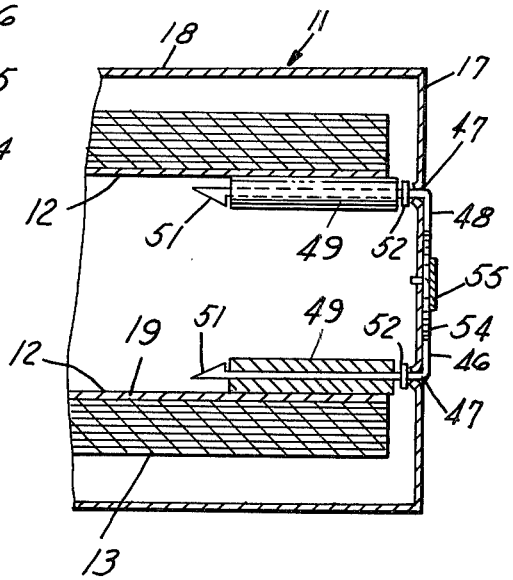
FIG. 6 is a fragmentary vertical section taken along line 6—6 of FIG. 5.

In FIGS. 5 and 6 is shown a further embodiment of this invention. In this embodiment, a roll retaining means 45 takes the shape of a U-shaped rod 46 comprising two end segments 47 integrally connected by a center segment 48. On each of the end segments 47 is pivotally mounted a sleeve 49 with the tips of the end segments 47 bent over to provide a piercing means 51. A retainer 52 is integrally formed on the end segments 47 outward of the sleeves 49 to retain the sleeves 49 on the segments 47. The center segment 48 has, in this instance, a flattened portion 53, that is circular in shape, which can either be integrally formed therewith or welded thereto as best seen in FIG. 5. The flattened portion 53 serves as an attachment means 54 to the outside surface of the end wall 17 of the box 11. As seen in FIG. 6, the roll retaining means 45 is installed by pushing the end segments 47 with the sleeves 49 mounted thereon into the box 11 through the end wall 17 utilizing the piercing means 51 to provide ingress. The sleeves 49 are pushed into the box 11 from the outside until the flattened portion 53 abuts the outside surface of the end wall 17. A tape 55 is used in this instance as seen in FIG. 5 to secure the roll retaining means 45 to the box 11 by mounting the tape 55 over the flattened portion 53 and the end wall 17. The sleeves 49 are in tangential contact or relationship with the inner peripheral surface 12 of the roll 12 at two opposite positions as seen in FIG. 6 to prevent movement of one end of the roll 12 in the box 11 when the sheeting 13 is dispensed therefrom. A second roll retaining means 45 can be inserted through the opposite end wall 17 of the box 11 if desired.

Figure 7:
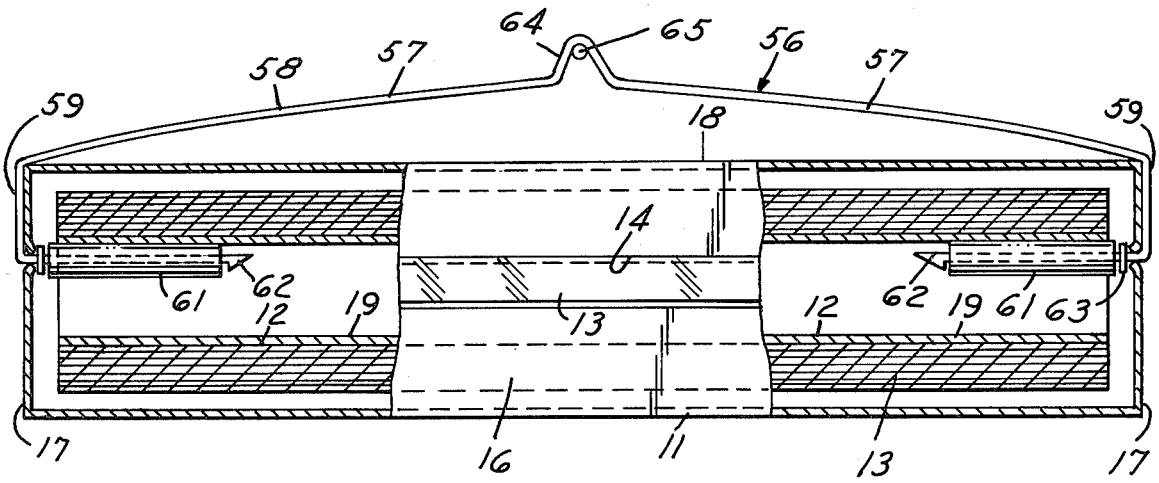
FIG. 7 is a frontal view, partially in section, of a box incorporating a fourth embodiment of the roll retaining means of this invention.

A further embodiment of this invention is shown in FIG. 7. In this embodiment, a roll retaining means 56 comprises a rod 57 formed from a spring wire which has a center segment 58 that extends the entire longitudinally length of the box 11. The box 11 contains a roll 12 of paper, foil, or plastic sheeting 13. At each end of the center segment 58 and integrally formed therewith is a L-shaped end segment 59 which extends downward and inward. On the inward portion of each end segment 59 is a pivotally mounted sleeve 61. A piercing means 62 is provided at each tip of the end segments 59 to provide a means for piercing the end walls 17 of the box 11 and also to retain the sleeves 61 on the rod 57. A further retaining means 63 is provided on the end segments 59 outward of the sleeves 61 to keep the pivotally mounted sleeves 61 from axially sliding. At approximately the middle of the longitudinally extending center segment 58 is an integrally formed loop 64 which serves as a fulcrum to permit the end segments 59 to be bent upward about the loop 64. This allows the sleeves 61 to be inserted through the end walls 17 or removed from the box 11 after having been inserted. The rod 57 being of spring wire provides sufficient spring action to allow the ready insertion of the sleeves 61 so as to have the sleeves 61 placed in tangential contact with the inner peripheral surface 19 at each end of the roll 12 contained within the box 11.

The loop 64 can also be used as a means for hanging the box 11 from a nail or hook 65 mounted in a wall or cabinet door. The advantage of this embodiment shown in FIG. 7 is in that it combines the two separate roll retaining means usually required in the other embodiments heretofore discussed into one unitary structure to retain the roll 12 in the box 11. It also incorporates a means for hanging up the box 11 to make dispensing more convenient.

In view of these specifications, those skilled in the art will be able to make many modifications thereof. It is intended that all such modifications be included within the scope of the appended claims:

I claim:

1. A roll retaining means adapted for retaining a roll of sheeting material in a box, wherein the roll has an inner peripheral surface and the box has end walls and side walls, said retaining means comprising:

(a) a rod having at least two segments, (b) a piercing means provided on one of said segments for piercing an end wall, (c) a sleeve provided on said one of said segments adjacent to said piercing means, said sleeve being insertable through an end wall after said piercing means has pierced said end wall so that said sleeve is positioned in a tangential relationship with the inner peripheral surface of said roll, and (d) an attachment means on the other of said segments, said attachment means securing said roll retaining means to the box.

2. The roll retaining means of claim 1 wherein said attachment means comprises a flat disc in juxtaposition with one of the walls of said box and a securing means, said securing means securing said flat disc to the box.

3. The roll retaining means of claim 2 wherein the securing means comprises a spike integrally formed with said flat disc.

4. The roll retaining means of claim 1 wherein said sleeve is pivotally mounted on one of said segments.

5. The roll retainer means of claim 1 wherein said one of said segments lies in a plane normal to the plane in which said other of said segments lies.

6. The roll retaining means of claim 5 wherein said one of said segments is radially displaced from a vertical line passing through the center of said roll, said sleeve mounted thereon being in a tangential relationship with the inner peripheral surface of the roll at a position offset from said vertical line.

7. The roll retaining means of claim 1 wherein said rod is U-shaped with said one of the segments being inserted through the end wall of the box and said other of the segments being in juxtaposition with one side wall of the box.

8. The roll retaining means of claim 1 wherein said rod is L-shaped with one of said segments inserted through the end wall of the box and said other of said segments being in juxtaposition with one end wall of the box.

9. A roll retaining means adapted for retaining a roll of sheeting material in a box wherein said roll has an inner peripheral surface and the box has two end walls and four side walls, said roll retaining means comprising:

(a) a U-shaped rod having two end segments and one center segment, (b) a pair of sleeves, each of said sleeves pivotally mounted on each of said end segments, and (c) an attachment means on said center segment, said end segments being insertable through the end wall of said box so that said pair of sleeves are in a tangential relationship with the inner peripheral surface of said roll at two positions, said attachment means securing said roll retaining means to one of said end walls of said box.

10. A roll retaining means adapted for retaining a roll of sheeting material in a box wherein the roll has an inner peripheral surface and the box has two end walls and four side walls, said roll retaining means comprising (a) a rod having a longitudinally extending center segment and two end segments, said end segments having an inward facing end portion, (b) a sleeve mounted on each of said inward facing end portions, and (c) a piercing means at the tip of each of said inward facing end portions, said inward facing end portions being insertable through opposite end walls of said box so that the sleeves are in a tangential relationship with the inner peripheral surface of said roll at opposite ends thereof.

11. The roll retaining means of claim 10 wherein said rod is formed from spring wire.

12. The roll retaining means of claim 10 wherein said center segment has a loop integrally formed therewith.

* * * * *